US009512705B2

(12) United States Patent
Benson et al.

(10) Patent No.: US 9,512,705 B2
(45) **Date of Patent: *Dec. 6, 2016**

(54) MULTILATERAL BORE JUNCTION ISOLATION

(71) Applicant: Halliburton Energy Services, Inc., Houston, TX (US)

(72) Inventors: Cole A. Benson, Houston, TX (US); William S. Renshaw, Edmonton (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 445 days.

This patent is subject to a terminal disclaimer.

(21) Appl. No.: 13/944,252

(22) Filed: Jul. 17, 2013

(65) Prior Publication Data

US 2014/0102716 A1 Apr. 17, 2014

Related U.S. Application Data

(63) Continuation of application No. 13/944,168, filed on Jul. 17, 2013, now Pat. No. 8,794,328, which is a continuation of application No. PCT/US2012/060462, filed on Oct. 16, 2012.

(51) Int. Cl.

| | |
|---|---|
| ***E21B 43/10*** | (2006.01) |
| ***E21B 43/26*** | (2006.01) |
| ***E21B 43/08*** | (2006.01) |
| ***E21B 41/00*** | (2006.01) |

(52) U.S. Cl.

CPC ..... *E21B 43/26* (2013.01); *E21B 41/0035* (2013.01); *E21B 43/08* (2013.01); *E21B 43/10* (2013.01)

(58) Field of Classification Search

CPC .... E21B 41/0035; E21B 7/061; E21B 23/002; E21B 43/26; E21B 23/00; E21B 43/10; E21B 43/08; E21B 7/04

See application file for complete search history.

(56) References Cited

U.S. PATENT DOCUMENTS

| | | | | |
|---|---|---|---|---|
| 5,520,252 | A | 5/1996 | Mcnair | |
| 5,526,880 | A * | 6/1996 | Jordan, Jr. | E21B 33/16 166/291 |
| 5,829,518 | A | 11/1998 | Gano et al. | |
| 6,119,771 | A * | 9/2000 | Gano | E21B 33/14 166/117.6 |
| 6,241,021 | B1 * | 6/2001 | Bowling | E21B 41/0042 166/285 |

(Continued)

OTHER PUBLICATIONS

International Patent Application No. PCT/US2012/060462, International Search Report and Written Opinion, mailed Apr. 25, 2013 (13 Pages).

(Continued)

*Primary Examiner* — Yong-Suk (Philip) Ro

(74) *Attorney, Agent, or Firm* — Dean W. Russell; Kilpatrick Townsend & Stockton LLP

(57) ABSTRACT

A junction can be isolated from fracturing pressure using a liner extending from a one bore through a junction into a lateral bore, where at least a portion of the liner is retrievable from the lateral bore prior to completion of wellbore construction. The junction may be temporarily isolated from high pressure, such as high pressure from a fracturing stimulation process. Part of the liner can be retrieved using a disconnect mechanism or technique.

11 Claims, 11 Drawing Sheets

(56) References Cited

U.S. PATENT DOCUMENTS

| | | | | |
|---|---|---|---|---|
| 6,712,148 | B2 | 3/2004 | Fipke et al. | |
| 7,950,461 | B2 | 5/2011 | Schrader et al. | |
| 8,220,547 | B2 | 7/2012 | Craig et al. | |
| 8,286,699 | B2 * | 10/2012 | Ingraham | E21B 41/0035 166/117.6 |
| 2003/0121663 | A1 | 7/2003 | Weng et al. | |
| 2003/0221843 | A1 | 12/2003 | Fipke et al. | |
| 2006/0207763 | A1 * | 9/2006 | Hofman | E21B 43/00 166/281 |
| 2007/0158073 | A1 | 7/2007 | Green | |
| 2008/0156496 | A1 * | 7/2008 | East | E21B 33/1208 166/313 |
| 2010/0163240 | A1 * | 7/2010 | Ingraham | E21B 41/0035 166/313 |
| 2010/0170677 | A1 | 7/2010 | Ingraham et al. | |
| 2011/0024121 | A1 | 2/2011 | Skeates et al. | |
| 2011/0114320 | A1 | 5/2011 | Sponchia et al. | |
| 2011/0308797 | A1 | 12/2011 | Umphries et al. | |
| 2012/0217014 | A1 * | 8/2012 | Groves | E21B 17/10 166/308.1 |

OTHER PUBLICATIONS

U.S. Appl. No. 13/944,168, Non-Final Office Action mailed on Mar. 10, 2014, 8 pages.

Basic Operational Sequence: FlexRite Multilateral System for Liner Conveyed Gravel Pack, Halliburton Energy Services, Inc, 2010, 37 pages.

U.S. Appl. No. 13/944,168, Notice of Allowance mailed on Apr. 22, 2014, 5 pages.

Australian Application No. 2012392527, First Examiner Report mailed on Apr. 14, 2015, 2 pages.

European Patent Application No. EP12886731.4, Extended European Search Report, mailed Jan. 12, 2016, 7 pages.

Canadian Patent Application No. 2,888,032 , Office Action, mailed Mar. 7, 2016, 3 pages.

Australian Patent Application No. 2015249040, First Examiner Report, mailed Jul. 13, 2016, 3 pages.

* cited by examiner

MULTILATERAL BORE JUNCTION ISOLATION

CROSS-REFERENCE TO RELATED APPLICATIONS

This is a continuation of U.S. application Ser. No. 13/944,168, filed Jul. 17, 2013, which is a continuation of PCT/US2012/060462, filed Oct. 16, 2012, each of which is incorporated herein by reference in its entirety.

TECHNICAL FIELD OF THE INVENTION

The present invention relates generally to assemblies and methods to be implemented in a wellbore and, more particularly (although not necessarily exclusively), to assemblies and methods for isolating a junction from fracturing pressure and for being retrievable prior to completion of wellbore construction.

BACKGROUND

Various devices can be installed in a well traversing a hydrocarbon-bearing subterranean formation. In a multilateral wellbore system, a junction can be between one bore and another bore. The junction may be one of the weakest points in a casing string of the wellbore system. Forces used to create or complete the well system can affect the casing or the formation exposed at the junction. One example of these forces is from fracture stimulation, such as from fracturing pressure.

Some assemblies can help reduce the amount of force experienced by the junction, but these assemblies are relatively large (for example requiring three or more points of isolation) and are implemented after a well system is completed.

Assemblies and methods for junction isolation are desirable that can isolate a junction prior to construction of the well system being completed and/or that are smaller.

SUMMARY

Certain aspects of the present invention are directed to isolating a junction from fracturing pressure using a liner extending from a one bore through a junction into a lateral bore, where at least a portion of the liner is retrievable from the lateral bore prior to completion of wellbore construction.

One aspect relates to a liner assembly that includes a liner body and an isolation mechanism exterior to part of the liner body. The liner body is partially positionable at a junction between a bore and a lateral bore of a well system through a subterranean formation. The isolation mechanism can cooperate with the liner body in isolating the junction from fracturing pressure for the lateral bore. At least part of the liner body is retrievable prior to construction of the well system being completed for production.

Another aspect relates to a method. A lateral bore is created in a well system that includes a bore by milling through a wall of the bore and drilling through a subterranean formation. A liner assembly that extends through a junction between the bore and the lateral bore is installed. The liner assembly includes a body and an isolation mechanism exterior to part of the liner body in the bore. The subterranean formation that is proximate to at least part of the lateral bore is fractured using fracturing pressure. The liner assembly isolates the junction from the fracturing pressure. At least part of the liner assembly is retrieved prior to completing construction of the well system for production.

Another aspect relates to a wellbore assembly that includes a whipstock, a liner body, a first isolation mechanism and a second isolation mechanism. The whipstock can direct drilling tools for creating a lateral bore in a subterranean formation at a junction with a bore. The liner body can extend through the junction and the lateral bore from the bore. The first isolation mechanism and the second isolation mechanism can cooperate with the liner body in isolating the junction from fracturing pressure for fracturing the subterranean formation that is proximate to part of the lateral bore. The first isolation mechanism is exterior to part of the liner body that can be in the bore. The second isolation mechanism is exterior to part of the liner body that is in the lateral bore. At least part of the liner body is retrievable from the well system prior to construction of the well system being completed for production.

These illustrative aspects and features are mentioned not to limit or define the invention, but to provide examples to aid understanding of the inventive concepts disclosed in this disclosure. Other aspects, advantages, and features of the present invention will become apparent after review of the entire disclosure.

DETAILED DESCRIPTION

Figure 2:
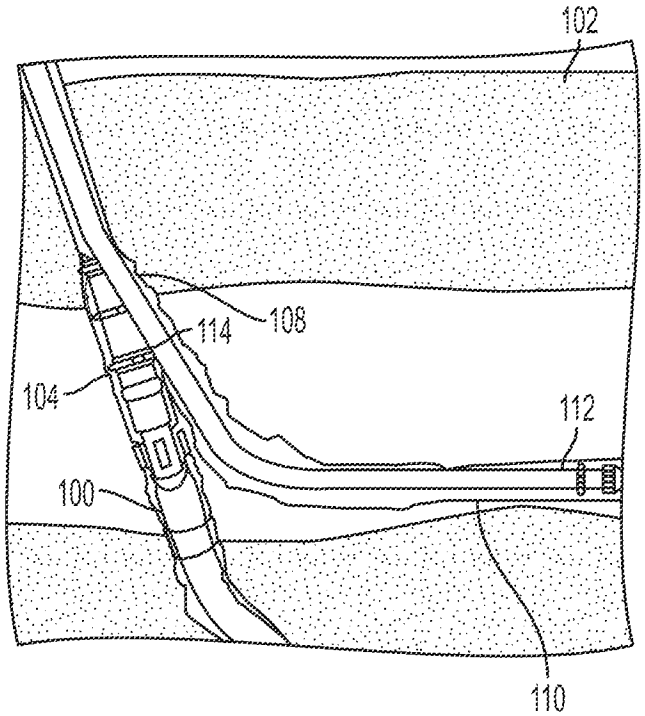
FIG. 2 depicts by cross-section drilling a lateral bore from the bore according to one aspect of the present invention.

Certain aspects and features relate to isolating a junction from fracturing pressure using a liner extending from a one bore through a junction into a lateral bore, where at least a portion of the liner is retrievable from the lateral bore prior to completion of wellbore construction. The junction may be temporarily isolated from high pressure, such as high pressure from a fracturing stimulation process. Isolating the junction from high pressure can include preventing the junction from experience forces from the high pressure or otherwise protecting the junction from being damaged during the fracturing stimulation process.

In some aspects, a casing exit can be milled out of a first bore and the lateral bore created by drilling to a desired depth or location. After the lateral bore has been created, a liner can be run into the lateral, such as across a whipstock or by using a bent joint, and a retrievable packer can be set in the first bore closer to the surface than the window in the first bore for the lateral bore. The portion of the liner in the lateral bore can include any and one or more of a swell packer, stimulation sleeves, cementing equipment or packers. The liner, including certain components, can isolate the junction from pressure from fracturing stimulation performed in the lateral bore subsequent to the liner being run.

At least part of the liner can be retrieved (i.e. removed from the wellbore) prior to the wellbore being completed to regain flow from below the junction. In some aspects, the entire liner is retrieved. In other aspects, part of the liner is retrieved and another part remains in the wellbore system.

The liner or part of the liner can be retrieved by various methods and using various devices and mechanisms. In one aspect, the liner includes a mechanical and/or hydraulic disconnect mechanism that can be located in part of the liner that can be in the lateral bore. The disconnect mechanism can be activated subsequent to the fracturing stimulation process by rotating, pulling, shearing, shifting a sleeve, or applying hydraulic forces to shift a component. An activated disconnect mechanism can allow part of the liner, such as part of the liner connected to a retrievable packer, to disconnect from the remaining part of the liner (or from another component in the lateral bore) and be retrieved.

In another aspect, the liner includes two or more liner sections that are fastened together for sealing and providing pressure isolation. When the packer is retrieved, the liner can shear at the fastened sections such that the liner sections separate from each other. The liner sections can separate such that the lower section can remain downhole and the upper section, which may be attached to a retrievable packer, can be retrieved.

In another aspect, a cutting tool that includes a mechanical or chemical cutting mechanism is run downhole using wireline, coiled tubing, or another running tool. The cutting tool can enter an internal bore defined at least in part by the liner. The liner can respond to the cutting mechanism be disconnecting and being retrieved. Some aspects of the liner include a profile on an inner wall that can receive part of the running tool to allow the running tool to be run to the proper location.

After the retrievable packer and the liner portion are retrieved, the whipstock (if used) can be retrieved to regain access to the first bore.

Certain aspects can save rig time in comparison to previous junction isolation techniques by reducing the number of trips downhole to isolate the junction and by reducing the complexity of completing a fracture stimulated multilateral junction. Certain aspects can avoid the use of seals for pressure integrity and can facilitate a greater pressure isolation rating.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit, the present invention.

Figure 1:
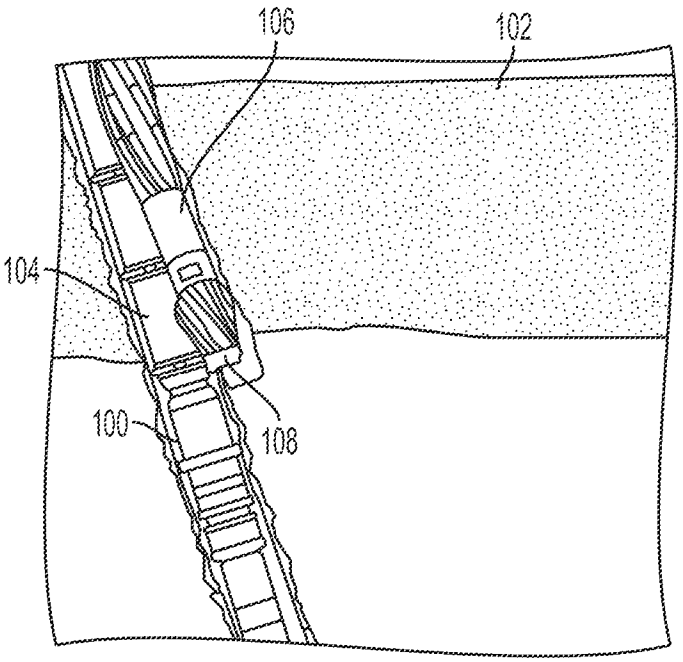
FIG. 1 depicts by cross-section milling a casing exit window in a bore according to one aspect of the present invention.

FIGS. 1-8 depict one aspect of isolating a junction by a liner assembly, at least part of which can be retrieved prior to completion of construction of the wellbore system. FIG. 1 depicts a bore 100 through a subterranean formation 102. A whipstock 104 is set in the bore 100 and is depicted as diverting a milling tool 106 run from the surface (not shown) for creating an exit window 108 in casing that is in the bore 100.

FIG. 2 depicts a lateral bore 110 created by a drilling tool 112 diverted through the casing exit window 108 by whipstock 104. At the casing exit window 108 is a junction 114 between the bore 100 and the lateral bore 110.

Figure 3:
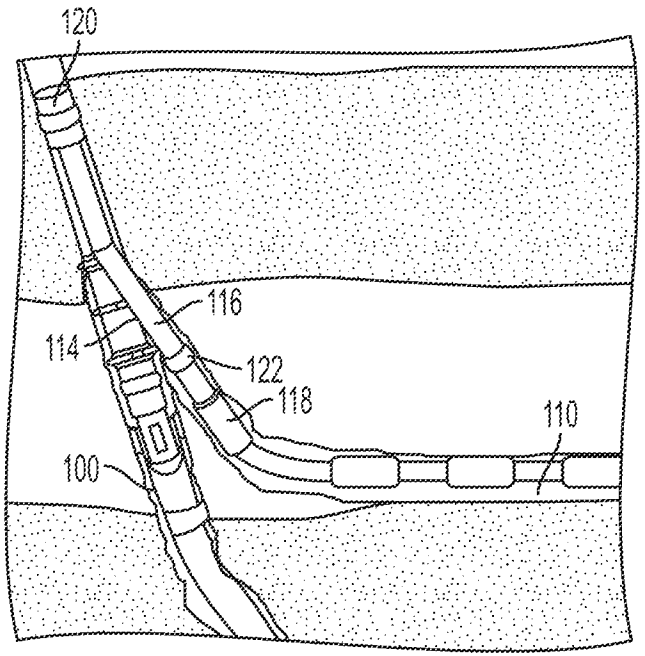
FIG. 3 depicts by cross-section a liner assembly in the bore and lateral bore with packers before being in a set position according to one aspect of the present invention.

FIG. 3 depicts a liner assembly 116 that is run downhole and extends from the bore 100 through the junction 114 to the lateral bore 110. The liner assembly 116 includes or is associated with isolation mechanisms, such as a packer 118 in the lateral bore 110 and a retrievable packer 120 in the bore 100. Packer 118 may be a swellable packer that surrounds a portion of the body of the liner assembly 116 that is located in the lateral bore 110. In some aspects packer 118 surrounds a portion of tubing in the lateral bore 110 to which the liner assembly 116 couples or of which the liner assembly 116 is a section. Retrievable packer 120 may surround a portion of the body of the liner assembly 116 that is in the bore 100. Although retrievable packer 120 is described as a retrievable packer, it may be other types of isolation mechanisms. In some aspects, a retrievable liner hanger can be used in place of the retrievable packer 120. The liner assembly 116 in FIG. 3 includes a disconnect mechanism 122 that is in a portion of the liner assembly 116 that is in the lateral bore 100.

Figure 4:
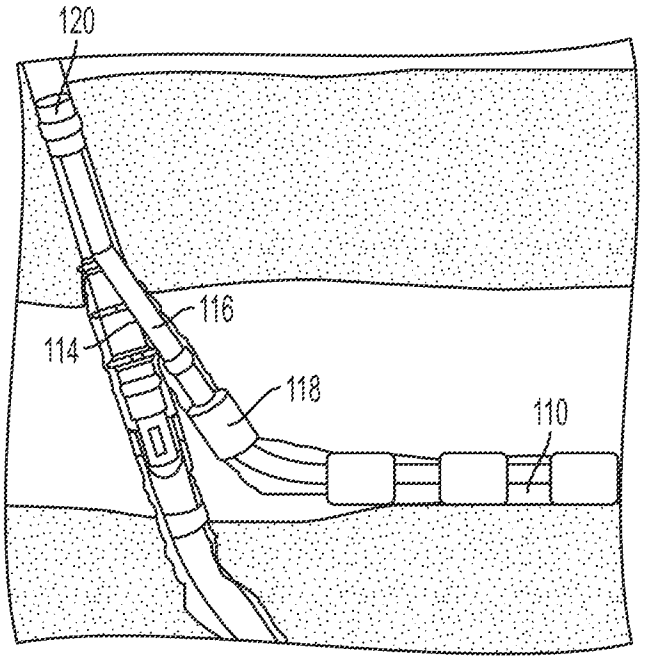
FIG. 4 depicts by cross-section the packers in a set position according to one aspect of the present invention.

Drilling rig equipment at the surface may then be moved off location and a workover rig brought in. Doing so may allow time for swell packers, such as packer 118 to expand or otherwise set. FIG. 4 depicts packer 118 and other packers in the lateral bore 110 in a set position. The liner assembly 116 in cooperation with packer 118 and retrievable packer 120 can isolate the junction 114 from high pressure. Packer 118 in the set position can provide one point of isolation for the junction 114. Retrievable packer 120 can provide a second point of isolation for the junction 114.

Figure 5:
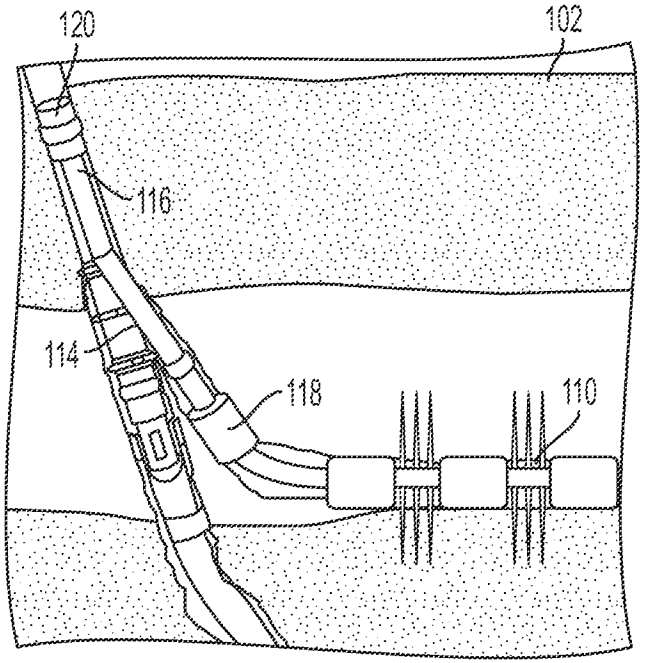
FIG. 5 depicts by cross-section a fracturing stimulation process applied to the lateral bore according to one aspect of the present invention.

FIG. 5 depicts the lateral bore 118 undergoing a fracture stimulation process for creating fractures in the subterranean formation 102 adjacent to part of the lateral bore 110. The fracture stimulation process can include various operations applied to the lateral bore 110. For example, the fracture stimulation process can include using a perorating gun to create openings in the lateral bore casing, pumping fracturing fluid into the lateral bore 110, using sliding sleeves or doors for providing and preventing access through the openings in the lateral bore casing. During the fracture stimulation process in which high pressure is introduced into the well system, the liner assembly 116, including packer 118 and retrievable packer 120, can isolate the junction 114 from the high pressure.

Figure 6:
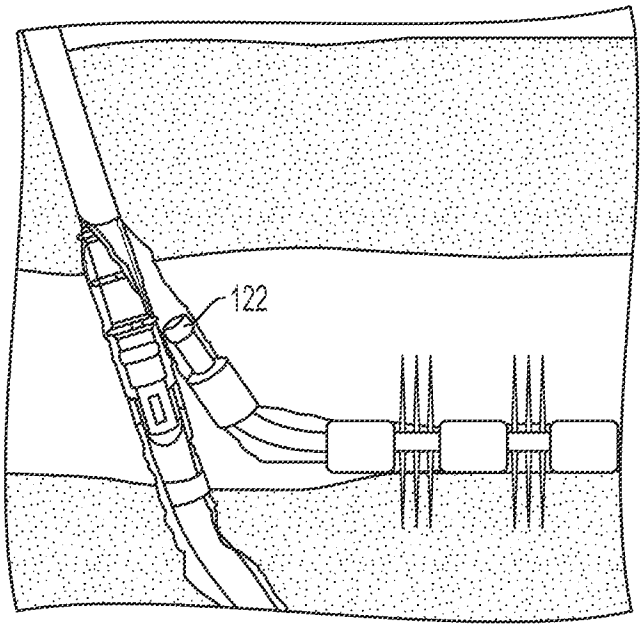
FIG. 6 depicts by cross-section part of the liner assembly disconnected and retrieved from the well system according to one aspect of the present invention.

Subsequent to the fracturing stimulation process and prior to construction of the well system is completed and the well system is ready for production, part of the liner assembly 116 can be retrieved from the well system. FIG. 6 depicts the well system with part of the liner assembly 116 from FIG. 5 removed at the disconnect mechanism 122. In some aspects, the disconnect mechanism 122 can be activated using one or more various techniques, some of which are described in following sections. In response, the disconnect mechanism 122 can allow part of the linear assembly 116 to disconnect and be, along with the retrievable packer 120 from FIG. 5, retrieved using a tool such as a packer retrieval tool.

Figure 8:
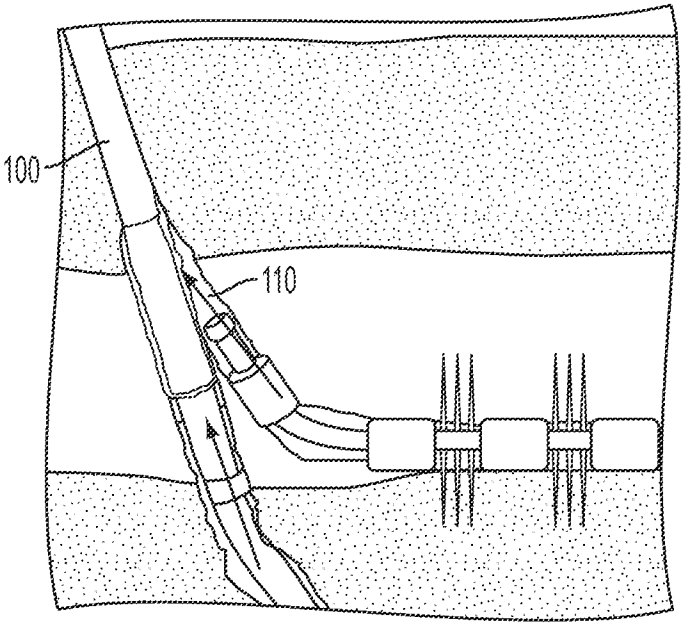
FIG. 8 depicts by cross-section a well system in production after construction is completed according to one aspect of the present invention.
Figure 7:
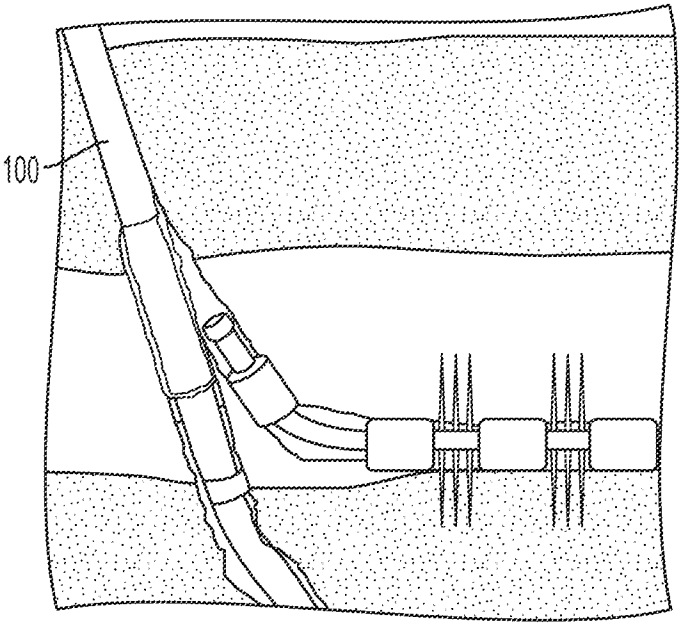
FIG. 7 depicts by cross-section a whipstock retrieved from the bore according to one aspect of the present invention.

Subsequent to part of the liner assembly 116 being retrieved, the whipstock 104 can be retrieved, construction of the well system can be completed, and the well system can be brought into production. FIG. 7 depicts the well system after the whipstock 104 has been retrieved from the bore 100. FIG. 8 depicts the well system in production by arrows representing fluid flow through the lateral wellbore 110 and the bore 100 toward the surface.

In other aspects, the liner assembly 116 can isolate the junction 114 and be retrieved prior to completion of construction of the wellbore system without implementing every step depicted in FIGS. 1-8. For example, in some aspects, the whipstock can remain in the bore 100 instead of being retrieved.

Figure 9:
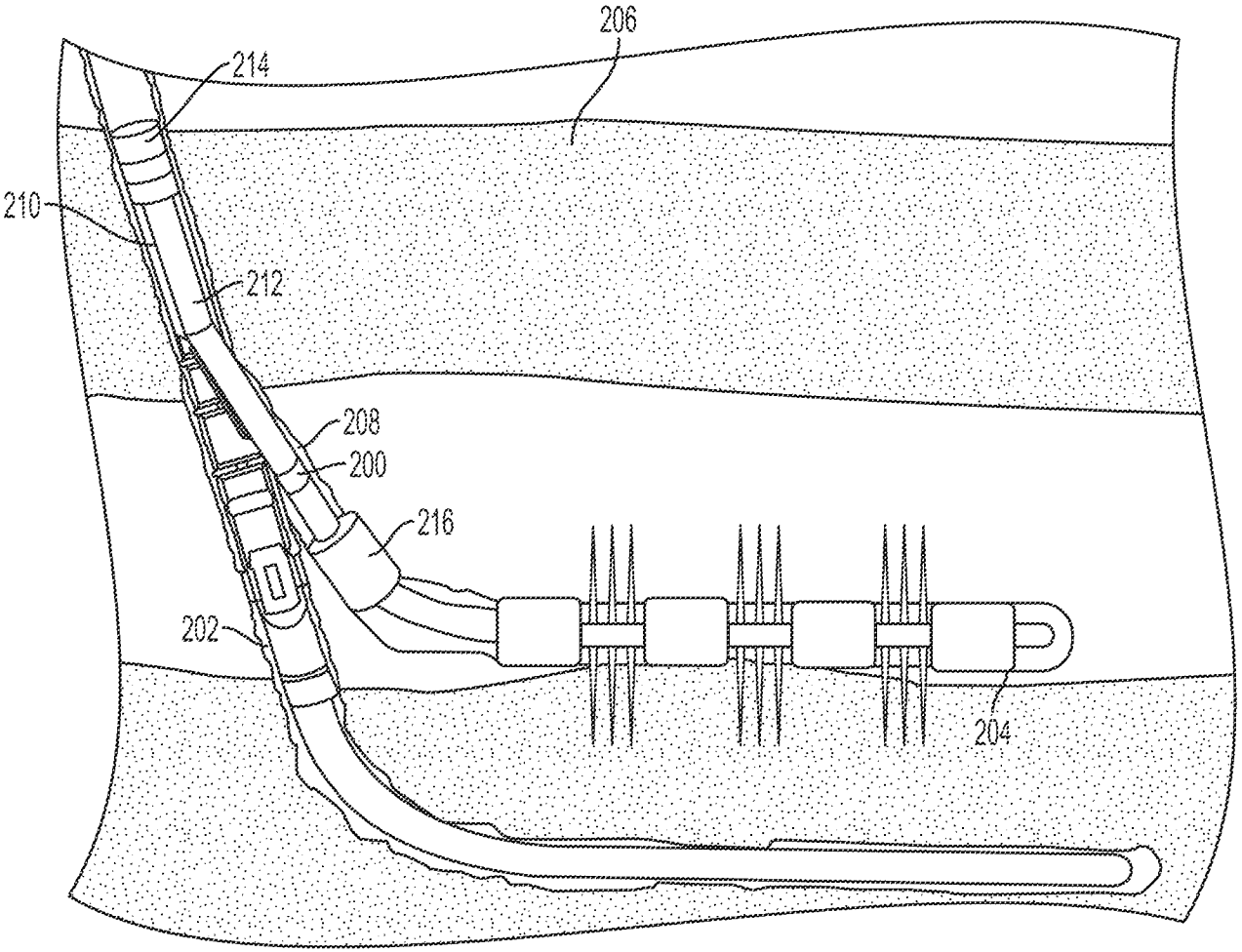
FIG. 9 depicts by cross-section a well system with a liner body having a disconnect mechanism according to one aspect of the present invention.
Figure 10:
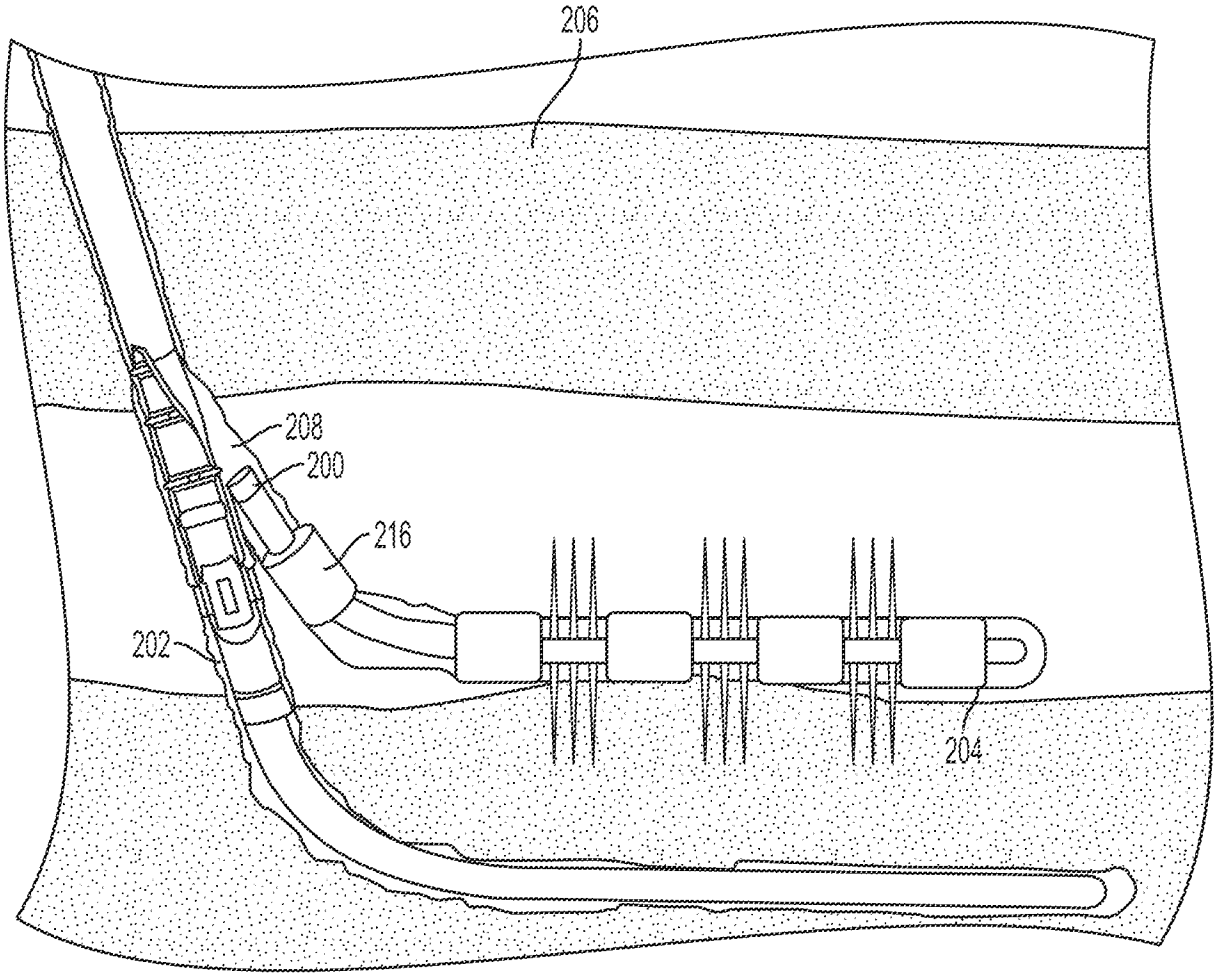
FIG. 10 depicts the well system of FIG. 9 after part of the liner body has been disconnected and retrieved according to one aspect of the present invention.

At least part of a liner assembly can be disconnected for retrieval using various techniques. FIGS. 9-10 depict one example of doing so using a disconnect mechanism 200 that is a mechanical or hydraulic disconnect mechanism. In FIGS. 9-10 is depicted a bore 202 and lateral bore 204 through a subterranean formation 206. A junction 208 is between the bore 202 and the lateral bore 204. A liner assembly 210 extends from the bore 202 to the lateral bore 204 through the junction 208. The liner assembly 210 includes a liner body 212 and an isolation mechanism that is a retrievable packer 214 exterior to part of the liner body 212 that is in the bore 202. The liner body 212 can cooperate with the retrievable packer 214 and/or other isolation mechanisms, such as packer 216 in the lateral bore 204 to isolate the junction from fracturing pressure.

The liner assembly 210 also includes the disconnect mechanism 200 in part of the liner body 212 that is in the lateral bore 204. The disconnect mechanism 200 can be activated by a mechanical or hydraulic force subsequent to the fracturing stimulation process. An activated disconnect mechanism 200 can respond to the mechanical or hydraulic force by allowing at least part of the liner body 212 to detach from another part of the liner body 212. The part of the liner body 212, which can include a section exterior to which is the retrievable packer 214, allowed to detach can be retrieved from the well system, as shown in FIG. 10.

Figure 11:
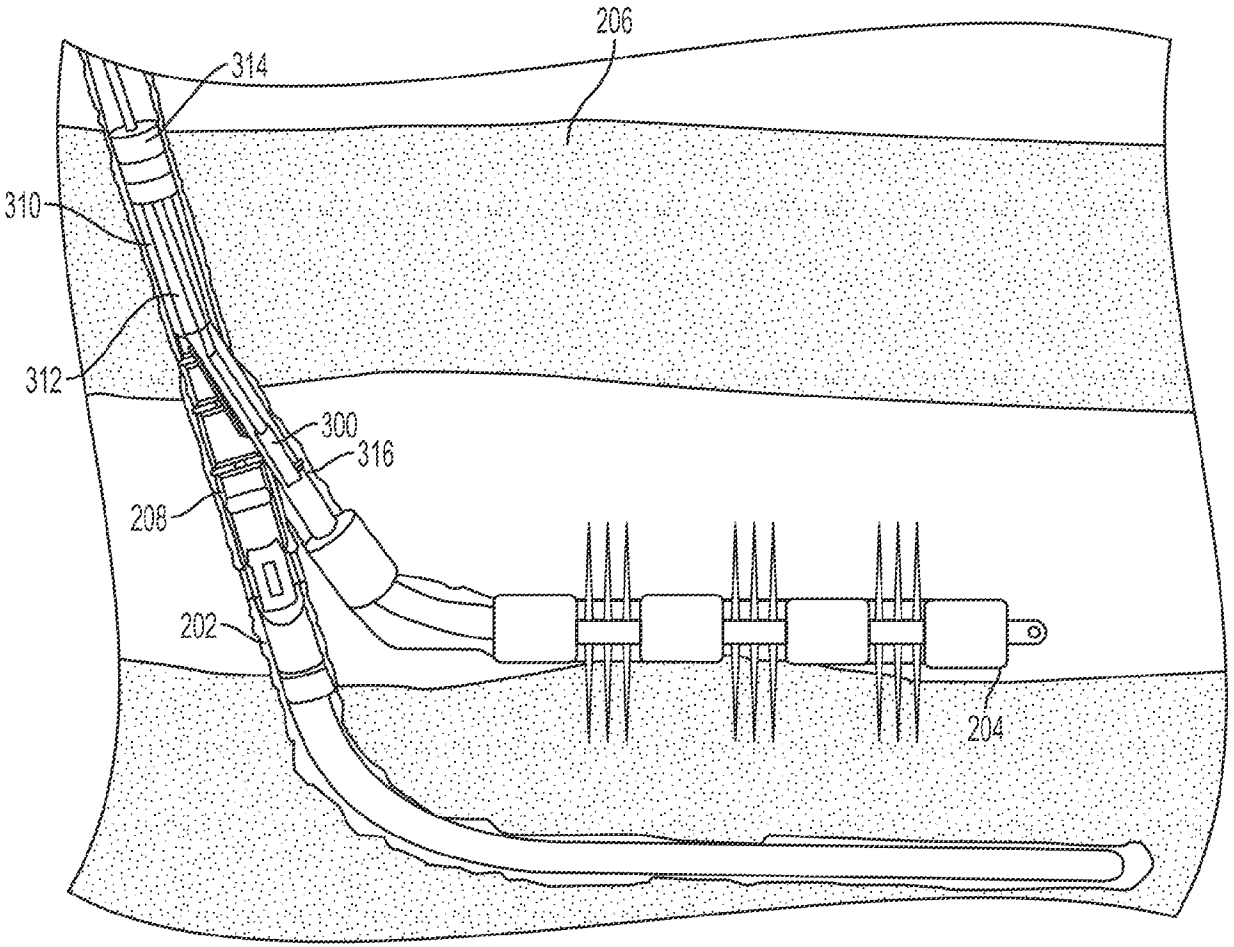
FIG. 11 depicts by cross-section the well system of FIG. 9 with a liner assembly according to another aspect of the present invention that can respond to a cutting tool.
Figure 12:
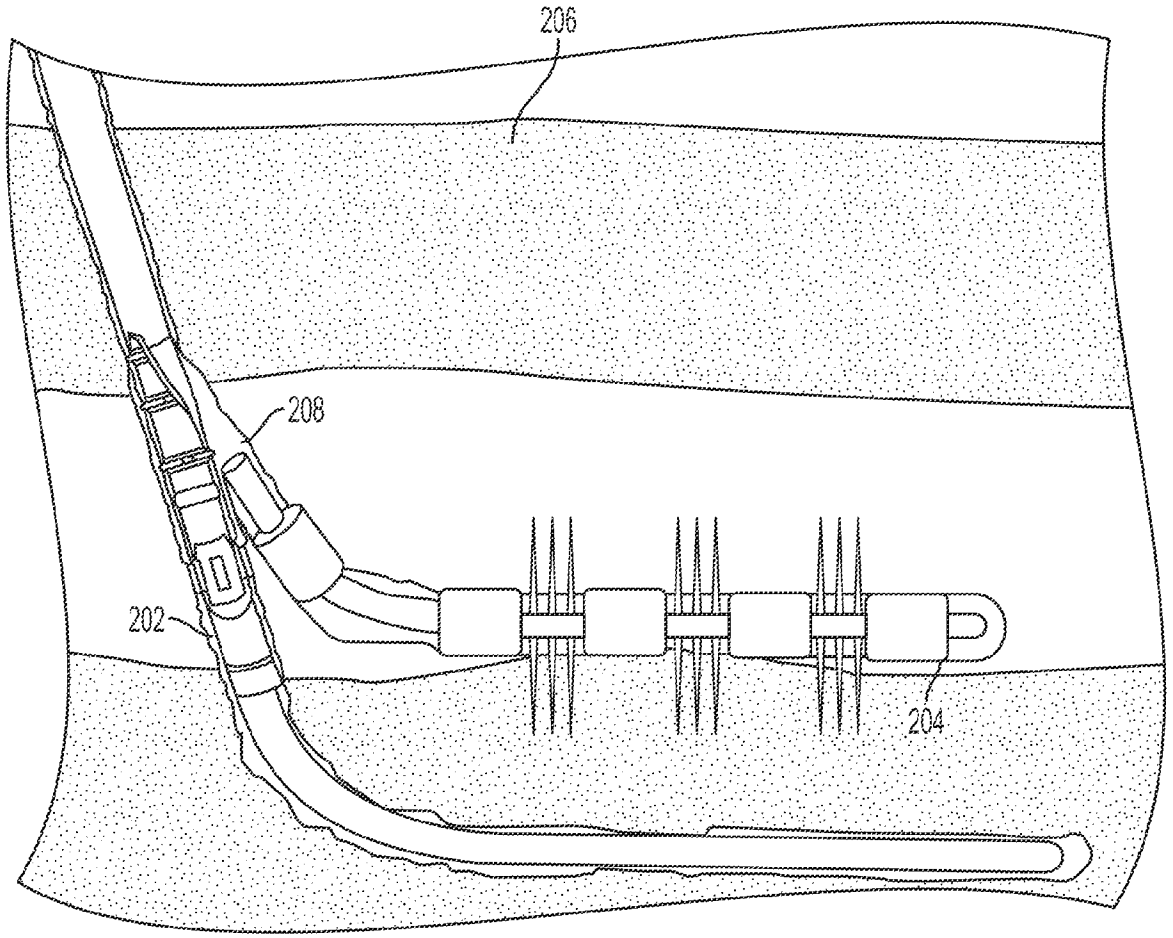
FIG. 12 depicts the well system of FIG. 9 after part of the liner body has been cut by the cutting tool and retrieved according to one aspect of the present invention.

FIGS. 11-12 depict another example of disconnecting part of a liner assembly for retrieval using a cutting tool 300 according to one aspect. The liner assembly 210 from FIGS. 9-10 is replaced with liner assembly 310 that includes a liner body 312 and an isolation mechanism that is a retrievable packer 314 exterior to part of the liner body 312 that is in the bore 202. The cutting tool 300 can be ran downhole from the surface and through an internal bore defied by the liner body 312 to a location that is farther from the surface than the position of the retrievable packer 314. The cutting tool 300 may be a liner cutting tool, such as one with blades or one that can output a chemical for cutting the liner body 312 at a desired position, such as at a disconnect mechanism 316 that may be a weakened part of the liner body 312 or otherwise a desired position at which the liner body 312 is to be cut. In some aspects, the liner body 312 includes a profile on an inner wall that is adapted for receiving part of the cutting tool 300 such that the cutting tool 300 cuts the liner body 312 at a desired location. The cutting tool 300 can be removed from the well system and part of the liner body 312 can be retrieved, as shown in FIG. 12.

Figure 13A:
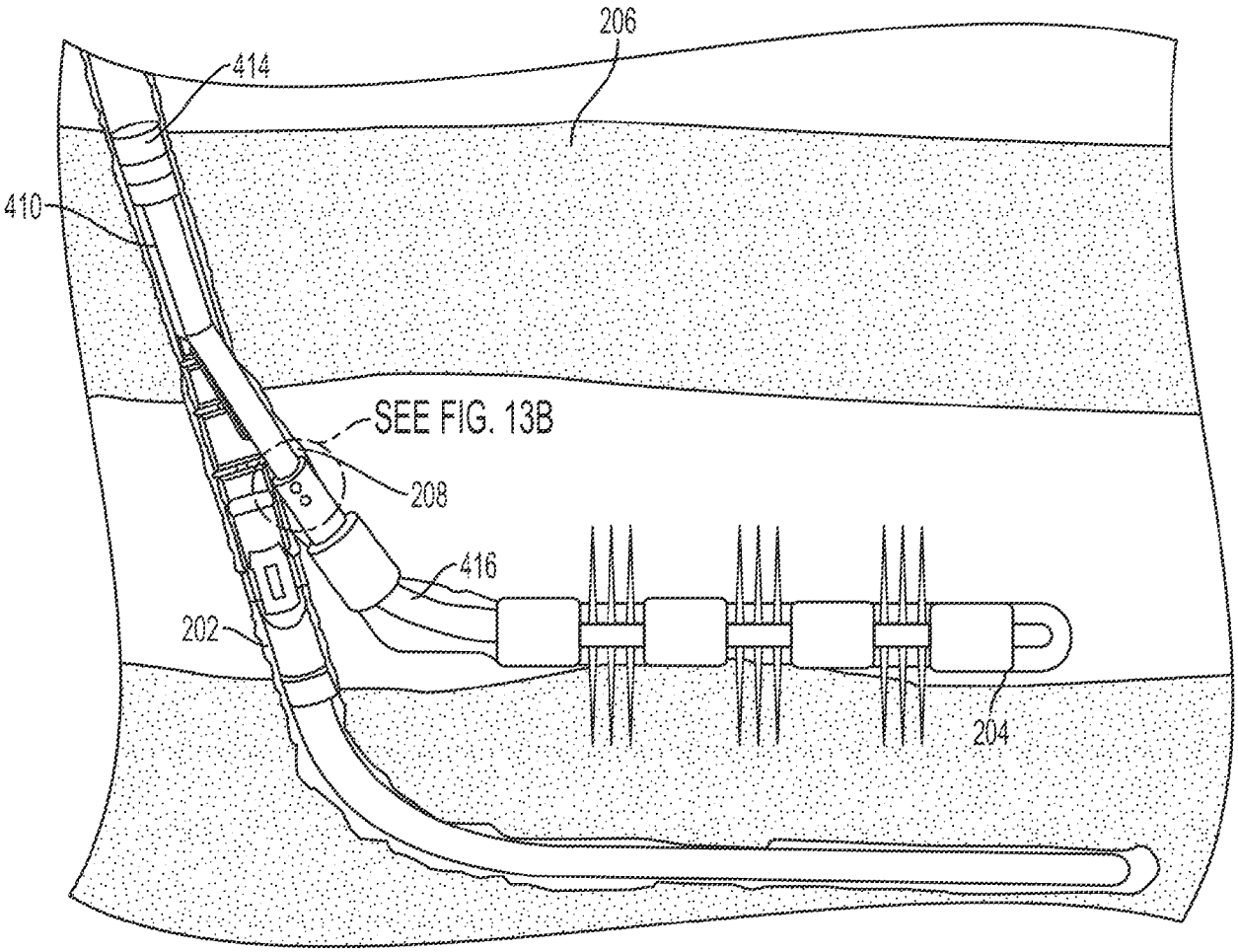
FIG. 13A depicts the well system of FIG. 9 with a disconnect mechanism that includes a shearable sleeve according to one aspect of the present invention.
Figure 13B:
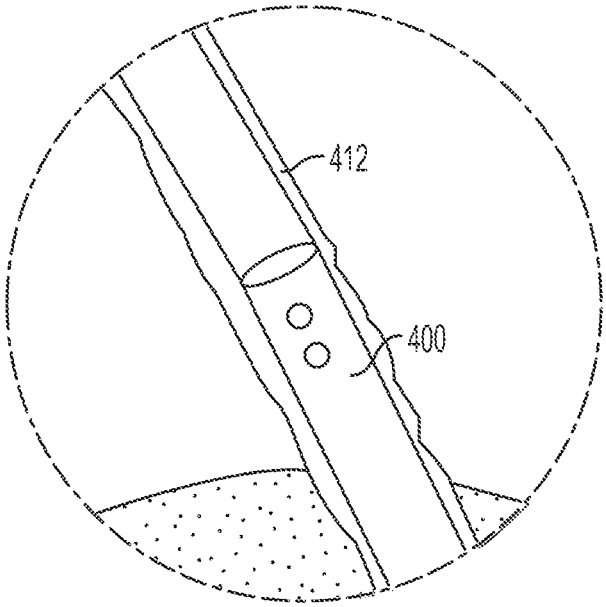
FIG. 13B depicts the shearable sleeve of FIG. 13A according to one aspect of the present invention.
Figure 14:
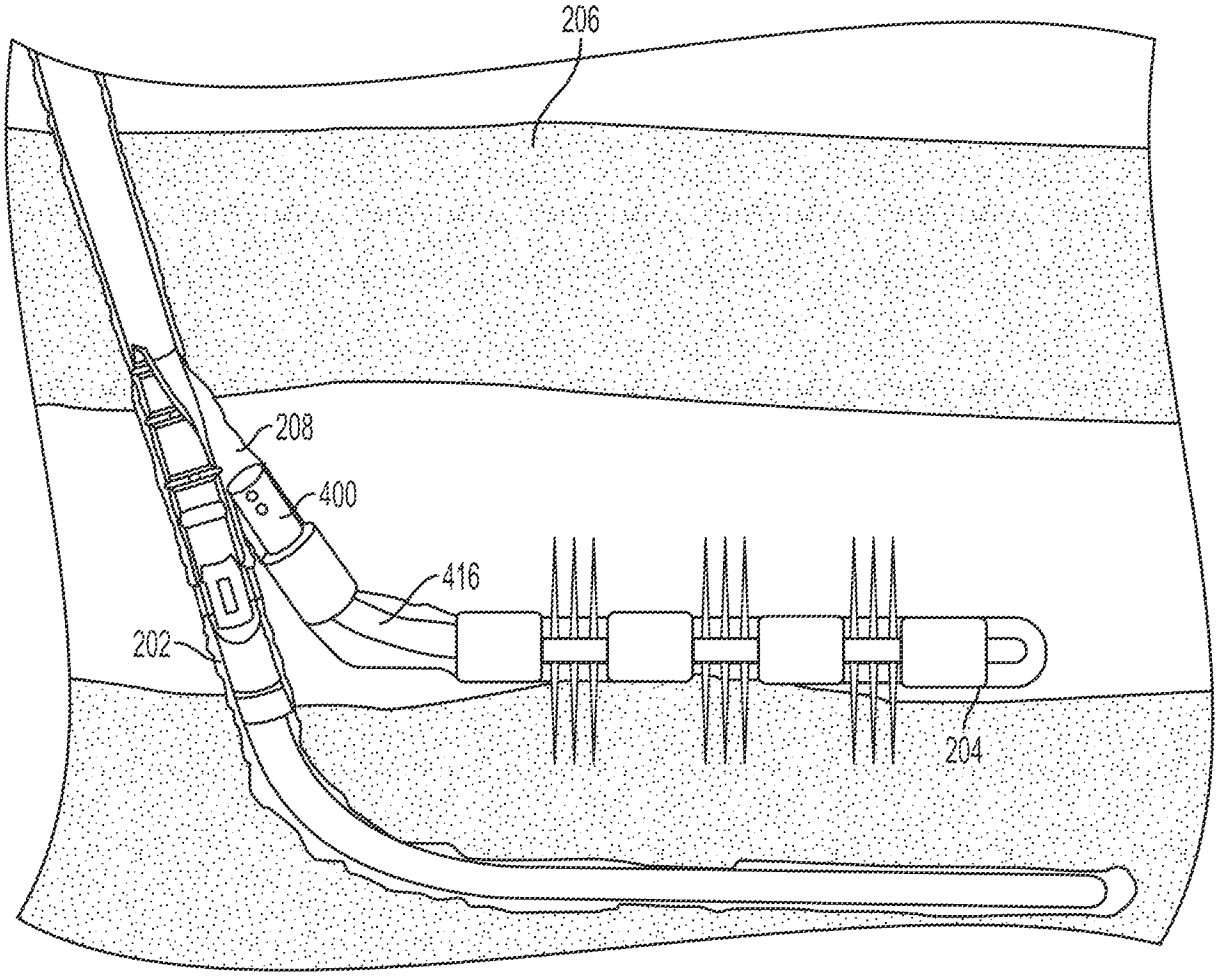
FIG. 14 depicts the well system of FIG. 9 after part of the liner body has been disconnected from the shearable sleeve and retrieved according to one aspect of the present invention.

FIGS. 13-14 depict another example of disconnecting part of a liner assembly for retrieval using a disconnect mechanism that is a shearable sleeve 400 according to one aspect. The liner assembly 210 from FIGS. 9-10 is replaced with liner assembly 410 that includes a liner body 412 and an isolation mechanism that is a retrievable packer 414 exterior to part of the liner body 412 that is in the bore 202. The liner body 412 can be coupled to the shearable sleeve 400 included with the liner assembly 410 using shearable pins or other coupling mechanisms, as shown in FIGS. 13A-B for example. The shearable sleeve 400 can be coupled to a safety sub-assembly 416 in the lateral bore 204. The shearable sleeve 400 and/or shearable pins can respond to a shearable force by disconnecting from liner body 412 and allowing the liner body 412 to be retrieved from the well system, as shown in FIG. 14. In other aspects, the shearable sleeve 400 is part of the safety sub-assembly 416 instead of the liner assembly 410.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A liner assembly, comprising:

a liner body partially configure to be positioned at a junction between a bore and a lateral bore of a well system through a subterranean formation;

an isolation mechanism exterior to a portion of the liner body that is configured to be positioned closer to a surface of the well system than the junction to cooperate with the liner body in isolating the junction from fracturing pressure for the lateral bore; and a disconnect mechanism in a part of the liner body that is configured to be positioned in the lateral bore, wherein the disconnect mechanism comprises a shearable mechanism adapted for coupling the liner body to a safety sub-assembly in the lateral bore and for allowing the portion of the liner body to detach from the safety sub-assembly in response to a mechanical force.

2. The liner assembly of claim 1, wherein the isolation mechanism is a first isolation mechanism, and the liner assembly further comprises a second isolation mechanism exterior to a second portion of the liner body that is configured to be positioned in the lateral bore.

3. The liner assembly of claim 1, wherein the portion of the liner body is retrievable prior to retrieval of a whipstock in the bore from the well system.

4. The liner assembly of claim 1, wherein the portion of the liner body is retrievable prior to construction of the well system being completed for production.

5. A method comprising: creating a lateral bore in a well system that includes a bore by milling through a wall of the bore and drilling through a subterranean formation;

installing a liner assembly that extends through a junction between the bore and the lateral bore, the liner assembly comprising a liner body and an isolation mechanism exterior to a portion of the liner body that is positioned in the bore closer to a surface of the well system that the junction;

fracturing the subterranean formation that is proximate the lateral bore using fracturing pressure, wherein the liner assembly isolates the junction from the fracturing pressure; and retrieving a portion of the liner assembly using a disconnect mechanism in a part of the liner body in the lateral bore by applying a shearing force that causes the disconnect mechanism that is a shearable mechanism to allow the portion of the liner assembly to disconnect and be retrieved from the well system.

6. The method of claim 5, further comprising:

producing fluid from the subterranean formation subsequent to retrieving the portion of the liner assembly.

7. The method of claim 5, further comprising:

running a whipstock to a position in the bore that is proximate to the junction; and retrieving the whipstock from the well system subsequent to retrieving the portion of the liner body.

8. The method of claim 5, wherein the isolation mechanism comprises:

a first isolation mechanism exterior to the portion of the liner body that is closer to a surface of the well system than the junction; and a second isolation mechanism exterior to a second portion of the liner body that is in the lateral bore.

9. The method of claim 5, further comprising:

retrieving the portion of the liner assembly prior to completing construction of the well system for production.

10. A wellbore assembly, comprising:

a whipstock adapted for directing drilling tools for creating a lateral bore in a subterranean formation at a junction with a bore in a well system;

a liner body adapted to extend through the junction and the lateral bore from the bore;

a first isolation mechanism and a second isolation mechanism that are adapted for cooperating with the liner body in isolating the junction from fracturing pressure for fracturing the subterranean formation that is proximate to the lateral bore, the first isolation mechanism being exterior to a portion of the liner body that is configured to be positioned closer to a surface of the well system than the junction, the second isolation mechanism being exterior to a second portion of the liner body that is configured to be in the lateral bore; and a disconnect mechanism in the part of the liner body configured to be positioned in the lateral bore, wherein the disconnect mechanism is configured for responding to a shearing force by allowing the portion of the liner body to disconnect and be retrieved.

11. The wellbore assembly of claim 10, wherein the portion of the liner body is retrievable from the well system prior to construction of the well system being completed for production.

* * * * *